US006086187A

United States Patent [19]

Hattori et al.

[11] Patent Number: 6,086,187

[45] Date of Patent: Jul. 11, 2000

[54] INK JET HEAD HAVING A SILICON INTERMEDIATE LAYER

[75] Inventors: Yoshifumi Hattori, Yamato; Masamichi Suzumura, Kamakura; Haruhiko Terai, Yokohama, all of Japan

[73] Assignee: Canon Kabushiki Kaisha, Tokyo, Japan

[21] Appl. No.: 08/257,436

[22] Filed: Jun. 8, 1994

Related U.S. Application Data

[63] Continuation of application No. 07/884,996, May 18, 1992, abandoned, which is a continuation of application No. 07/530,407, May 30, 1990, abandoned.

[30] Foreign Application Priority Data

May 30, 1989 [JP] Japan ..... 1-134701
Oct. 30, 1989 [JP] Japan ..... 1-279818

[51] Int. Cl.[7] ..... B41J 2/05

[52] U.S. Cl. ..... 347/63; 347/18

[58] Field of Search ..... 347/63, 64, 65, 347/62, 56, 205, 18; 338/59, 308; 257/713, 712; 428/448

[56] References Cited

U.S. PATENT DOCUMENTS

| | | | |
|---|---|---|---|
| 4,313,124 | 1/1982 | Hara | 347/57 |
| 4,330,787 | 5/1982 | Sato | 347/63 |
| 4,336,548 | 6/1982 | Matsumoto | 347/64 |
| 4,345,262 | 8/1982 | Shirato | 347/56 |
| 4,429,321 | 1/1984 | Matsumoto | 347/59 |
| 4,458,256 | 7/1984 | Shirato | 347/58 |
| 4,459,600 | 7/1984 | Sato et al. | 347/56 |
| 4,463,359 | 7/1984 | Ayata et al. | 347/56 |
| 4,499,480 | 2/1985 | Takatori et al. | 347/56 |
| 4,513,298 | 4/1985 | Scheu | 347/64 |
| 4,532,530 | 7/1985 | Hawkins | 347/62 |
| 4,558,333 | 12/1985 | Sugitani et al. | 347/65 |
| 4,596,994 | 6/1986 | Matsuda | 347/64 |
| 4,612,533 | 9/1986 | Nagaoka | 347/202 |
| 4,616,408 | 10/1986 | Lloyd | 347/64 X |
| 4,663,640 | 5/1987 | Ikeda | 347/63 |
| 4,719,477 | 1/1988 | Hess | 347/59 |
| 4,723,129 | 2/1988 | Endo et al. | 347/56 |
| 4,740,796 | 4/1988 | Endo et al. | 347/56 |
| 4,887,099 | 12/1989 | Terai et al. | 347/63 |
| 4,894,664 | 1/1990 | Pan | 347/63 |
| 4,926,197 | 5/1990 | Childers | 347/63 |
| 5,134,018 | 7/1992 | Tokunaga | 428/448 X |

FOREIGN PATENT DOCUMENTS

| | | | |
|---|---|---|---|
| 0244214 | 11/1987 | European Pat. Off. | B41J 3/04 |
| 0289130 | 11/1988 | European Pat. Off. | B41J 3/04 |
| 0332764 | 9/1989 | European Pat. Off. | B41J 3/04 |
| 3008487 | 9/1980 | Germany | G06K 15/02 |
| 60-71260 | 4/1958 | Japan | B41J 3/04 |
| 54-56847 | 5/1979 | Japan | B41M 5/26 |
| 59-106974 | 6/1984 | Japan | B41J 3/04 |
| 59-123670 | 7/1984 | Japan | B41J 3/04 |
| 59-138461 | 8/1984 | Japan | B41J 3/04 |
| 362035842 | 3/1987 | Japan | B41J 3/04 |

*Primary Examiner*—Joseph Hartary
*Attorney, Agent, or Firm*—Fitzpatrick, Cella, Harper & Scinto

[57] ABSTRACT

The present invention is related to an ink jet head comprising a substrate having a support, an intermediate layer provided on said support and a lower layer provided on said intermediate layer, and a heat energy generating member which generates heat energy to be utilized for discharging ink provided on said substrate. The ink jet head is characterized in that ink channels communicated to discharge openings for discharging ink are formed corresponding to the heat generating portions of said heat energy generating member on said heat generating substrate, and the thermal conductivity of said intermediate layer is selected higher than that of said support and higher than that of said lower layer.

17 Claims, 11 Drawing Sheets

(1) SUBSTRATE INCLUDING ALUMINA/Si ACCORDING TO THE PRESENT INVENTION (2) GLASS SUBSTRATE ALUMINA GLAZED SUBSTRATE

INK JET HEAD HAVING A SILICON INTERMEDIATE LAYER

This application is a continuation of application Ser. No. 07/884,996 filed May 18, 1992, now abandoned, which in turn was a continuation of application Ser. No. 07/530,407 filed May 30, 1990, now abandoned.

BACKGROUND OF THE INVENTION

1. Field of the Invention

This invention relates to an ink jet head or a liquid jet head, a substrate for ink jet head to be used for forming said head, and an ink jet device having the above-mentioned head.

2. Related Background Art

A typical example of the structure of a liquid jet recording head utilizing heat energy for discharging liquid is shown in FIGS. 1A and 1B. FIG. 1A is a partial front view as seen from the discharge opening side of a liquid jet recording head, and FIG. 1B a partial sectional view when cut along the portion shown by the chain line XY in FIG. 1A.

The recording head 100 has structure having discharging openings or orifices 104 and liquid channels 105 formed thereon by bonding a grooved plate 103 having a predetermined number of grooves of predetermined width and depth provided at a predetermined line density of the surface of a heat-generating substrate 102*a* including a plate-shaped support 102 having the heat-generating portions 101 of electricity-heat converters provided thereon so as to cover over the surface.

The recording head shown in the Figures has a plurality of discharge openings 104, but a recording head having a single discharge opening has been also known.

The liquid channels 105 are communicated at their terminal ends to the discharge openings 104 for discharging liquid, and have heat-acting portions 106 which are sites or areas where heat energy generated by the heat-generating portions 101 of the electricity-heat convertors act on the liquid. The heat-acting portions 106 are positioned at the upper parts of the heat-generating portions 101 of the electricity-heat convertors, and have the heat-acting surfaces 108 as the surfaces in contact with the liquid as their bottom surfaces.

On the support 102 are provided a lower layer 109, a heat-generating resistance layer 110 provided on said lower layer 109 and a first protective layer 111 comprising, for example, an inorganic insulating material provided on said heat-generating resistance layer 110, etc. The heat-generating resistance layer 110 is provided on its surface side with electrodes 113, 114 for passing current to said layer 110 for generating heat. The electrode 113 is an electrode common to the respective heat-generating portions, while the electrode 114 is a selective electrode for generating heat by selecting the respective heat-generating portions and is provided in a pattern shape along the liquid channel.

In the liquid jet recording head having a constitution as described above, current is passed in pulse shape to the heat-generating portions 101 existing between the electrodes 113, 114 of the heat-generating resistance layer 110 through these electrodes, and liquid is discharged by heating liquid with the heat-acting surface 108. For transmitting efficiently the heat generated at the heat-generating portion 101 during current passage, the lower layer 109 becomes a barrier against transfer to the support 102 during heating, whereby heat is transmitted primarily from the heat-acting surface to liquid. For this reason, as the material forming the lower layer 109, a material with relatively smaller thermal conductivity, for example, an inorganic oxide such as $SiO_2$, a transition metal oxide such as titanium oxide, niobium oxide, etc. is selected, and diffusion of heat toward the support 102 side is suppressed by the lower layer 109. For example, U.S. Pat. No. 4,458,256 is directed to an ink jet recording apparatus having actuating portions, lead electrodes wired in a particular manner for conducting current, and a recording head including a substrate, an insulating layer, and a conductive layer.

However, in the prior art example as mentioned above, heat may be sometimes accumulated in the lower layer 109 when the recording head is continuously driven for a long time, whereby temperature elevation of the whole recording head 100 may be brought about. Moreover, when such heat accumulation in the lower layer 109 becomes marked, the following phenomenon are liable to be induced:

(1) unstabilization of forming at the heat-acting portion 106 by excessive heat energy transmitted to the liquid during current passage to the heat-generating portion 101 due to temperature elevation of the lower layer 109;

(2) discharge unstabilization due to increased amount of dissolved oxygen precipitated into the liquid channel on account of temperature elevation of the liquid near the heat-acting portion 106, and (3) increase of the droplets discharged accompanied with temperature elevation.

When these phenomena (1), (2) and (3) occur, no stable droplet discharging state at the recording head can be obtained, whereby there may be sometimes caused the problem to occur that no stable recording operation with good recording images can be done, particularly in prolonged continuous recording operation.

The background arts concerned as mentioned above are described by referring to other drawings.

The liquid jet recording head utilizing heat energy for discharging liquid for recording such as ink, etc. has a constitution, as shown in FIGS. 2A and 2B, having liquid channels 6 communicated to the orifices 7 through which liquid is discharged provided at the positions corresponding to the heat-generating portions 2*a* of the heat-generating substrates 8 constituted by arrangement of the heat-generating resistors 2 possessed by the heat energy generating members for generating heat energy which acts on liquid, said liquid channels having liquid chambers 10 for feeding liquid.

The heat-generating substrate 8, as shown in FIGS. 3A and 3B, can be obtained by laminating at least the heat-generating resistance layer 2 and the electrode layer 3 on the substrate 1, subjecting these to patterning into a predetermined shape at predetermined intervals, and forming heat-generating portions 2*a* connected electrically to a pair of electrodes (3*a*, 3*b*). On the electrodes (3*a*, 3*b*) possessed by the heat-generating substrate 8 and/or the heat-generating portion 2*a*, various upper layers such as protective layer 4, etc. may be provided, if necessary. For example, European Patent Application No. 0,289,139 is directed to a substrate for an ink jet recording head having a support member, an electro-thermal converter provided on the support member having a heat generating resistive layer and a pair of electrodes connected to the heat generating resistive layer, and a glaze layer provided between the support member and the electro-thermal converter except at a heat generating portion defined between the pair of electrodes.

As the substrate 1 to be utilized for formation of a heat-generating substrate 8 to be used for the liquid jet recording head of such constitution, plate materials comprising silicon, glass and ceramics, etc. have been employed in the prior art.

A silicon substrate has relatively sufficient performances for use as the substrate for liquid jet recording head, but high degree of technique is required for formation of a substrate with a large size corresponding to enlargement of recording head, and yet the cost is also high.

Further, in a recording head having a glass substrate assembled therein, due to inferior thermal conductivity of glass substrate, when the driving frequency of the pulses imparted to the heat-generating resistors is made higher, excessive heat accumulation may sometimes occur at the substrate portion, whereby the liquid existing within the recording head is heated to include bubbles, and defects such as defective discharging of liquid, etc. are liable to occur.

On the other hand, as ceramics substrate, alumina substrate has been utilized from the points that it can manufacture a substrate with relatively larger size and that thermal conductivity is better as compared with glass. However, because of the manufacturing technique which calcines starting material powder, surface defects such as pinholes or projections with sizes of several $\mu$m to several 10 $\mu$m are liable to be generated, and its surface roughness is about Rs 0.15 in most cases. As influenced by these, the recording head having an alumina substrate assembled therein has short durability life in many cases. Moreover, improvement of the surface characteristic of an alumina substrate having surface defects by mechanical treatment is extremely difficult, because alumina itself is a material of high hardness.

As the substrate compensating for the defects of alumina substrate, there has been known the so called alumina glaze substrate improved in surface roughness by coating the surface alumina with molten glass. However, the glaze layer comprising glass possessed by the alumina glaze substrate is limited in making its layer thickness thinner (about 40–50 $\mu$m or less) in its preparation method, and therefore there may be sometimes caused the problem of excessive heat accumulation in the substrate to occur similarly as in the case of glass substrate.

Also, the substrate for recording head is required to have good balance of heat accumulatability and heat dissipatability, and there is also a constitution having additionally a heat accumulation layer provided on the substrate surface for taking the balance of these. For example, in the case of such substrate equipped with such heat accumulation layer by use of ceramics such as alumina, etc., a film of low thermal conductivity such as $SiO_2$ layer, etc. has been formed on the predetermined surface of a ceramics plate material by use of vacuum film forming technique such as sputtering.

However, by film formation according to vacuum film formation technique, there have been involved such problems that the film forming speed is slow, and yet dust, etc. may be sometimes also entrained during film formation, and also no heat accumulation of sufficient quality can be obtained in many cases.

SUMMARY OF THE INVENTION

An object of the present invention is to provide a liquid jet recording head which can solve the problems caused by the heat accumulation phenomenon as described above in a liquid jet recording head utilizing heat energy for discharging liquid, namely having a structure necessary for stabilization of recorded images during prolonged continuous actuation, etc., a substrate for said head and an ink jet device equipped with said head.

Another object of the present invention is to provide a liquid jet recording head having good balance of heat dissipatability and heat accumulatability, also excellent characteristics such as durability, etc. and which can be easily enlarged in area, a substrate for said head, and an ink jet device equipped with said head.

Another object of the present invention is to provide an ink jet head comprising a substrate having a support, an intermediate layer provided on said support and a lower layer provided on said intermediate layer, and a heat energy generating member which generates heat energy to be utilized for discharging ink provided on said substrate, characterized in that ink channels communicated to discharge openings for discharging ink are formed corresponding to the heat generating portions of said heat energy generating member on said heat generating substrate; and the thermal conductivity of said intermediate layer is higher than that of said support and higher than that of said lower layer.

Still another object of the present invention is to provide an ink jet head comprising a substrate having a support comprising ceramics, an intermediate layer comprising silicon provided on said support and a lower layer provided on said intermediate layer, and a heat energy generating member which generates heat energy to be utilized for discharging ink provided on said substrate, characterized in that ink channels communicated to discharge openings for discharging ink are formed corresponding to the heat generating portions of said heat energy generating member on said heat generating substrate; and the thermal conductivity of said intermediate layer is higher than that of said lower layer.

Still another object of the present invention is to provide a heat-generating substrate for ink jet head comprising a substrate having a support, an intermediate layer provided on said support and a lower layer provided on said intermediate layer, and a heat energy generating member which generates heat energy to be utilized for discharging ink provided on said substrate, characterized in that ink channels communicated to discharge openings for discharging ink are formed corresponding to the heat generating portions of said heat energy generating member on said heat generating substrate and the thermal conductivity of said intermediate layer is higher than that of said support and higher than that of said lower layer.

Still another object of the present invention is to provide a heat-generating substrate for ink jet head comprising a substrate having a support comprising ceramics, an intermediate layer comprising silicon provided on said support and a lower layer provided on said intermediate layer, and a heat energy generating member which generates heat energy to be utilized for discharging ink provided on said substrate, characterized in that ink channels communicated to discharge openings for discharging ink are formed corresponding to the heat generating portions of said heat energy generating member on said heat generating substrate; and the thermal conductivity of said intermediate layer is higher than that of said lower layer.

Still another object of the present invention is to provide an ink jet device comprising an ink jet head having a heat generating substrate provided with a substrate having a support, an intermediate layer provided on said support and a lower layer provided on said intermediate layer, and a heat energy generating member which generates heat energy to be utilized for discharging ink provided on said substrate wherein ink channels communicated to discharge openings for discharging ink are formed corresponding to the heat generating portion of said heat energy generating member on said heat generating substrate and the thermal conductivity of said intermediate layer is higher than that of said support and higher than that of said lower layer and a power source switch.

Still another object of the present invention is to provide an ink jet device comprising an ink jet head having a heat generating substrate provided with a substrate having a support comprising ceramics, an intermediate layer comprising silicon provided on said support and a lower layer provided on said intermediate layer, and a heat energy generating member which generates heat energy to be utilized for discharging ink provided on said substrate, wherein ink channels communicated to discharge openings for discharging ink are formed corresponding to the heat generating portion of said heat generating member on said heat generating substrate and the thermal conductivity of said intermediate layer is higher than that of said support and higher than that of said lower layer and a power source switch.

DETAILED DESCRIPTION OF PREFERRED EMBODIMENTS

Figure 1A:
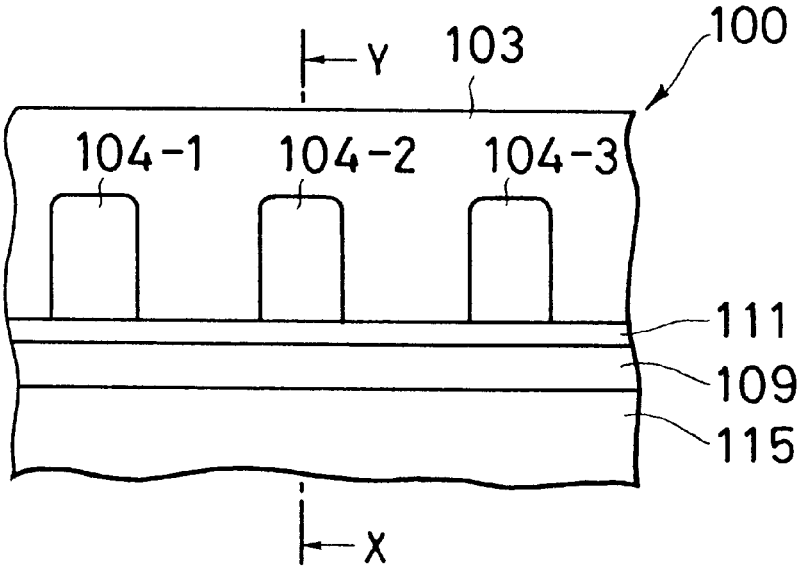
FIG. 1A PRIOR ART
FIG. 1A is a schematic front view showing an example of the ink jet head according to the background art of the present invention.
Figure 1B:
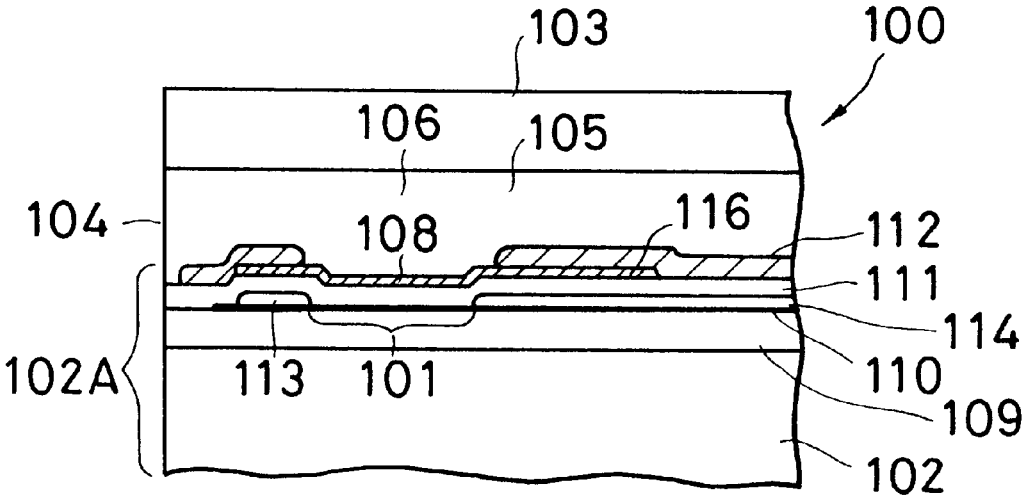
FIG. 1B PRIOR ART
FIG. 1B is a schematic sectional view taken along X-Y in FIG. 1A.

The heat-generating substrate for liquid jet recording head of the present invention comprises a heat energy generating member which generates heat energy provided on the lower layer provided on a support, wherein an intermediate layer having higher thermal conductivity than the above lower and the above support is provided at least between the above lower layer and the above support positioned lower than the above heat energy generating member.

The liquid jet recording head of the present invention is characterized by having a constitution in which liquid channels communicated to discharge openings are provided on the heat-generating substrate having the above constitution corresponding to the heat-generating portions possessed by said heat-generating substrate.

The thermal conductivity of the above lower layer is set to the extent so that good thermal efficiency can be obtained during droplet discharging, which may also differ depending on the thickness of the lower layer, etc., and appropriately a substance having a thermal conductivity of 0.01 cal/cm·sec·° C. or less may be provided with a layer thickness of about 0.5 $\mu$m to 5 $\mu$m as the above lower layer. On the other hand, the difference in thermal conductivity between the above intermediate layer, the above lower layer and the above support may be set to the extent which can prevent effectively the heat accumulation phenomenon as described above, for example, conveniently set corresponding to the area of the heat-generating portion, the amount of heat generated, etc. For example, when the thermal conductivities of the above intermediate layer, the above lower layer and the above support are defined as A, B and C, respectively, it is desirable that $A/B \geqq 2$ and $A/C \geqq 2$.

In the present invention, by having the above intermediate layer provided between the lower layer and the substrate below the heat-acting surface of the recording head, heat accumulation in the lower layer during prolonged continuous driving head, etc. can be prevented to suppresses the tempreature elevation of the recording head, whereby recorded images of stably high quality can be constantly obtained.

A particularly preferable embodiment in the present invention is one wherein the above-mentioned substrate has a ceramics base, a layer comprising silicon provided on said ceramics base and a lower layer provided on said layer comprising silicon.

Thus, the substrate of the present invention is repaired in the surface defects occurring on the ceramics base surface by a layer comprising silicion (hereinafter referred to as "silicion layer") provided on the ceramics base, also improved in its surface roughness, and yet good balance of heat dissipatability and heat accumulatability is imparted to said substrate. Also, by subjecting the surface of the silicon layer of the substrate of the present invention to polishing treatment, if necessary, better surface roughness can be also obtained on the silicon layer surface.

Further, by subjecting the silicon layer surface of the substrate of the present invention to, for example, heating oxidation treatment to form a $SiO_2$ layer there to form the lower layer, a good balance of heat dissipatability and heat accumulatability can be obtained. When, a $SiO_2$ layer is formed on the silicon layer surface possessed by the substrate of the present invention, said $SiO_2$ layer can be formed efficiently by a simple operation of the heating oxidation treatment of the silicon layer surface, whereby it can be formed within shorter time as compared with the film formation of $SiO_2$ layer according to, for example, the vacuum film formation technique.

Further, by constituting the liquid jet recording head by use of the substrate of the present invention, as liquid jet recording head excellent in discharging stability, durability, etc. can be provided without the problem of excessive heat accumulation in the substrate by use of a glass substrate or an alumina glaze substrate or without problem of deterioration of durability as in a ceramics substrate.

Referring now to the drawings, the present invention is described in detail about a representative example of ink jet head which has electricity-heat converters as the heat energy generating member for generating heat energy to be utilized for discharging of liquid.

Figure 4:
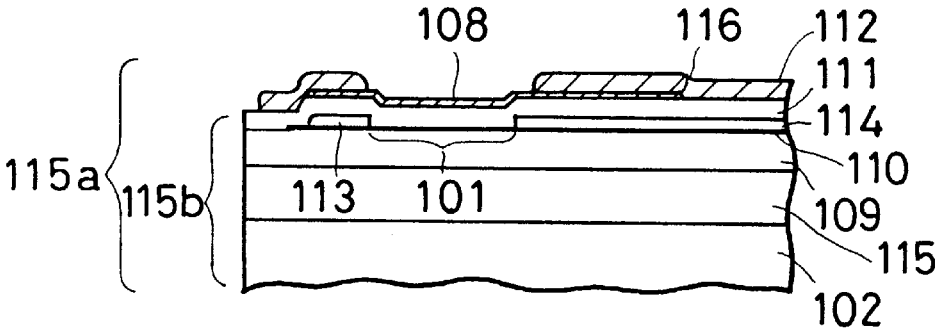
FIG. 4 is a schematic sectional view showing an example of the substrate for ink jet head according to the present invention.

FIG. 4 is a sectional view showing an example of the pertinent portions of the heat-generating substrate for liquid jet recording head of the present invention.

The heat-generating substrate has a constitution of having an intermediate layer 115 and a lower layer 109 laminated in this order on a support 102, and further having a heat-generating resistance layer 110, electrode layers 113, 114, a first protective layer 111, a second protective layer 116 and a third protective layer 112 in respective predetermined shapes laminated thereon. In this Example, the heat energy generating member is constituted of an electricity-heat converter having a heat-generating resistance layer 110 and electrode layers 113, 114. The support 102 can be constituted of silicon, glass, or preferably ceramics, etc.

The lower layer 109 is provided as the layer for controlling the flow of the heat generated from the heat generating portion 101 primarily toward the support 102 side, and its constituent material is chosen and its layer thickness is designed so that, when heat energy is permitted to act on the liquid at the heat-acting portion 106, the heat generated from the heat-generating portion 101 may be made to flow more toward portion 106, and when the current passage to the heat-generating portion of the electricity-heat converter 101 is made OFF, the heat remaining at the heat-generating portion 101 may flow rapidly toward the support 102 side. As the material constituting the lower layer 109, inorganic materials as represented by metal oxides such as $SiO_2$, zirconium oxide, tantalum oxide, magnesium oxide, etc. may be included.

The intermediate layer 115 is provided as the layer for preventing heat accumulation into the lower layer 109 during prolonged continuous driving of the recording head having said substrate assembled therein and diffusing heat therearound, and is formed of a material having higher thermal conductivity than the material of the above lower layer 109 and the material constituting the support 102.

Its layer thickness must be determined in view of the heat distribution of the whole recording head such as heat amount generated at the heat-generating portion 101 and the setting density, the materials and the thicknesses of the lower layer and the support, etc.

As the material constituting the intermediate layer 115, for example, when Si is employed as the support 102, $SiO_2$ as the lower layer 109, high thermal conductivity materials such as C, Mg, Al, Cu, Ag, Au, W, etc. may be included. Otherwise, when the material of the support is ceramics, glass, etc., those having lower thermal conductivity than the above materials, such as amorphous silicon, polycrystalline silicon or low thermal conductivity compounds, etc. can be also used. The intermediate layer 115 can be formed by use of such methods as electron beam vapor deposition or sputtering using the materials as mentioned above.

The heat-generating resistance layer 110 and the electrode layers 113, 114 can be formed by use of the materials and the methods conventionally used.

The protective layer with a multi-layer constitution comprising the first protective layer 111, the second protective layer 116 and the third layer 112 protects the heat-generating resistance layer 110 and the electrode layers 113, 114 from the liquid for recording within the recording head, and its constitution and the position to be located are not limited to those shown, but various constitutions can be made such as one comprising a single layer, etc.

The first protective layer 111 can be formed of inorganic insulating materials such as inorganic oxides (e.g. $SiO_2$, etc.) or inorganic nitrides (e.g. $Si_3N_4$, etc.), and the second protective layer 116 should be preferably constituted of a metal material which is tenacious, relatively excellent in mechanical strength and also can be closely contacted and adhered with the first protective layer, for example, Ta, etc. when the first protective layer is formed of $SiO_2$. Thus, constitution of the second protective layer of an inorganic material which is relatively tenacious and has mechanical strength such as metals, etc. can absorb sufficiently the shock from the cavitation action which occurs during liquid discharging particularly at the heat-acting surface 108, thus having the effect of elongating the life of the electricity-heat converter to great extent.

The third protective layer is constituted of an organic insulating material such as various resins, etc. excellent in liquid penetration prevention and liquid resistant action, and further desirably has the properties of (i) good film forming property, (ii) dense structure and little pinhole, (iii) no swelling with or dissolving in the ink employed, (iv) good insulation when formed into a film, and (v) high heat resistance, etc. These three kinds of protective layers can be formed by use of the materials and the methods disclosed in Japanese Patent Application Laid-Open No. 59-106974.

Figure 5A:
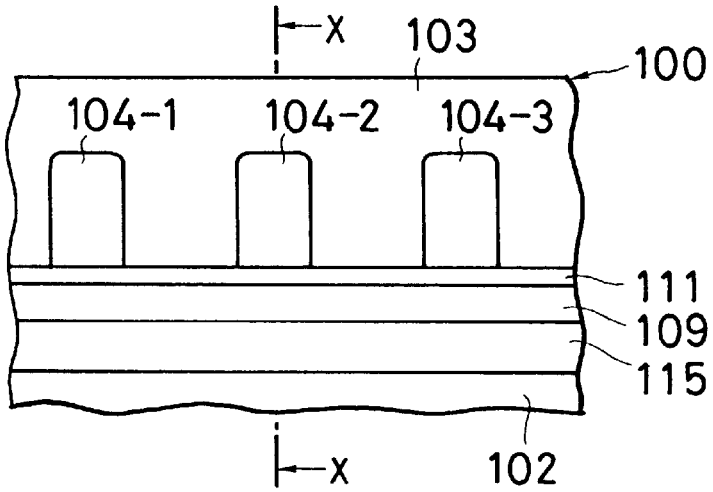
FIG. 5A is a schematic front view showing an example of the ink jet head according to the present invention, FIG. 5B a schematic sectional view taken along X—X in FIG. 5A, and FIG. 5C its schematic sectional view.
Figure 5B:
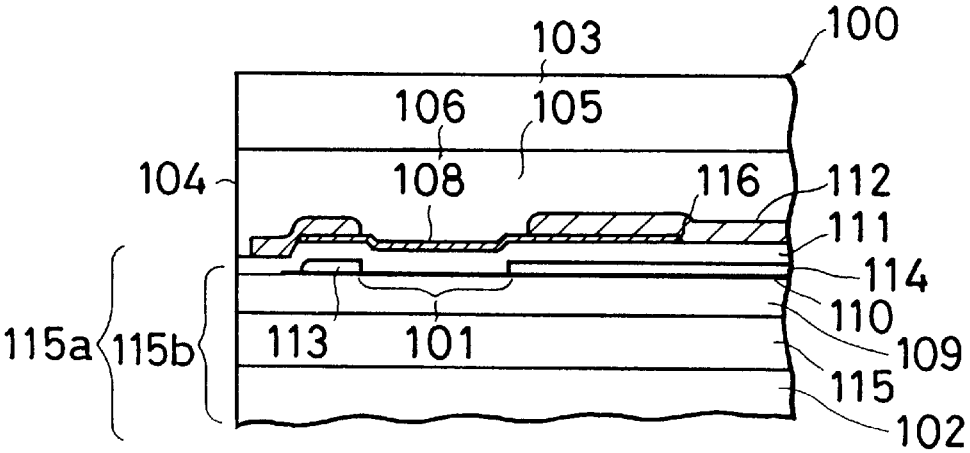
Figure 5C:
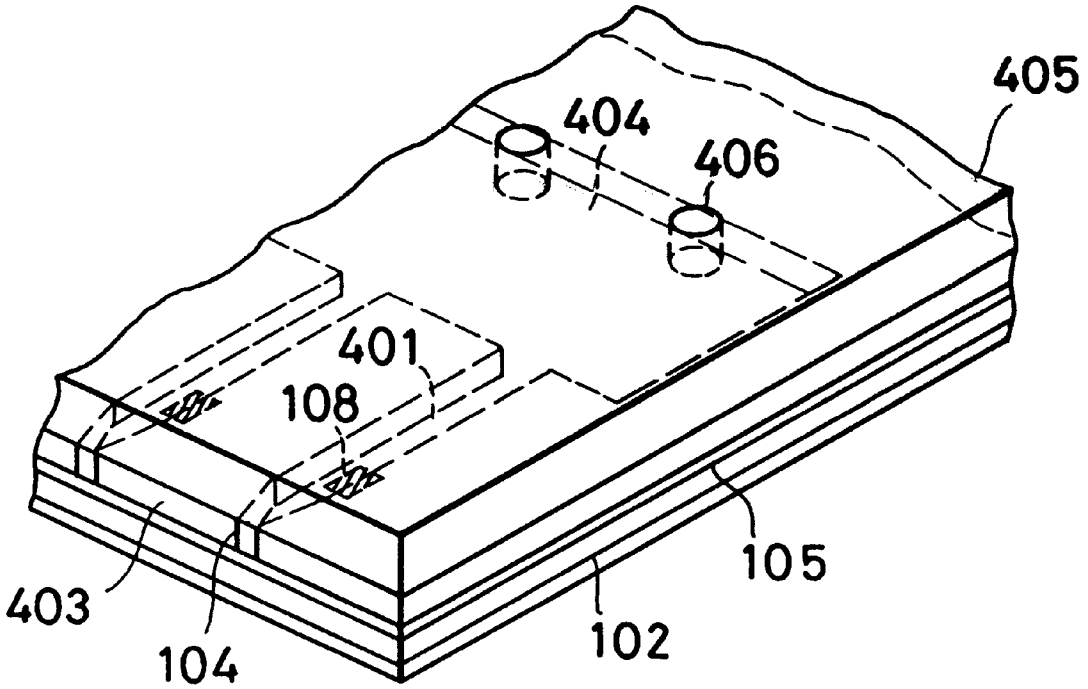

By forming the liquid channels communicated to at least the discharge openings at the positions corresponding to the heat-generating portions of the substrate having the constitution as described above, the liquid jet recording head of the present invention can be prepared. FIG. 5A, FIG. 5B and FIG. 5C show an example thereof.

FIG. 5A is a partial appearance view as seen from the discharge opening side of the liquid jet recording head of the present invention, FIG. 5B is a sectional view taken along X—X in FIG. 5A and FIG. 5C is a perspective view when using liquid channel side wall forming members and a ceiling plate as the grooved plate 103 with detailed portions being omitted.

The recording head 100 has discharge openings 104 and liquid channels 105 formed thereon by bonding the face having heat-generating portions 101 of the electricity-heat converter of the heat generating substrate 115*a* having a substrate 115*b* with the constitution shown in FIG. 4 so as to be covered with, for example, the grooved plate 103 formed of ceramics, glass, metal, plastic, etc. provided with grooves of predetermined width and depth at a predetermined line density. In place of the grooved plate 103, as shown in FIG. 5C, one having a ceiling plate 405 comprising glass plate, plastic plate, etc. bonded to the liquid channel side wall forming material 403 can be also employed.

The recording head shown in FIGS. 5A to 5C has a plurality of discharge openings 104, but of course the present invention is not limited to such an embodiment, and a recording head with a single discharge opening falls within the category of the present invention.

The liquid channel 105 is communicated to the discharge opening 104 for discharging liquid at, for example, its terminal end, and has the heat-acting portion 106 which is the site where heat energy generated from the heat-acting portion 101 of the electricity-heat converter acts on liquid. The heat-generating portion 106 is positioned at the upper part of the heat-generating portion 101, and has the heat-acting surface 108 of the upper protective layer portion of the heat-generating portion 101 as the surface in contact with the liquid and surface.

On the support 102 are provided the intermediate layer 115, the lower layer 109 provided on said intermediate layer 115, the heat-generating resistance layer 110 provided on said lower layer 109, the first protective layer 111 and the second protective layer 116 as its upper layer provided on said heat-generating resistance layer 110, etc. The heat-generating resistance layer 110 is provided on its surface side with electrodes 113, 114 for current passage to said layer 110 for generation of heat. The electrode 113 is an electrode common to the respective heat-generating portions, and the electrode 114 is a selective electrode for heat generating by selecting the respective heat-generating portions and is provided in a pattern along the liquid channel.

Also, on the surface in contact with liquid except for the region of the heat-generating portion 101 is provided the third protective layer 112, which may be also extended to the bottom surface of the common liquid chamber (not shown) upstream of the respective liquid channels 105.

In the liquid jet recording head, heat generation is effected by passing pulse-shaped current through the electrodes 113, 114 to the heat-generating portions 101 of the electricity-heat converter, and the stable foaming can be obtained at the heat-acting portion 106 by passing current at a short pulse width with a pulse time of about 2 to 15 $\mu$sec. By utilizing the bubbles, liquid is discharged from the discharge openings 104 to perform recording. Here, the heat generated from the heat-generating portions 101 foams the liquid, and also is conducted to the lower layer. The heat diffusing toward the lower layer is inhibited by the lower layer 109 provided beneath the heat-generating resistor 110 adjacent thereto, whereby the power required to be inputted during discharging can be suppressed minimum. When, said discharging actuation is further repeated at a certain period, namely when the liquid jet recording head is driven continuously for a long time, the heat generated from the heat-generating resistor 110 tends to be accumulated in the lower layer 109. However, in this example, heat accumulation in the lower layer 109 near the heat-generating portion 101 can be prevented by the intermediate layer 115 arranged between the lower layer 109 and the substrate 102, thereby diffusing the heat around the electricity-heat converter 101, whereby temperature elevation of the recording head 100, particularly temperature elevation of the liquid channel 115 can be prevented.

The constitutions other than the constitution having the intermediate layer provided between the lower layer at least below the heat-generating portion and the support are not limited to the constitutions as described above, but can take various constitutions.

For example, in the example as described above, the direction in which the liquid is supplied to the heat-generating portion is substantially the same as the direction in which the liquid is discharged from the discharge opening, but these directions may be different, such as at right angle, etc.

Referring now to drawings, a particularly preferable embodiment of the present invention is to be described in more detail.

Figure 6A:
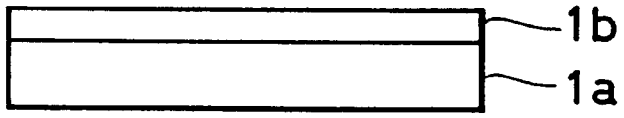
FIGS. 6A and 6B are respectively schematic sectional views showing an example of the member for preparation of the substrate for the ink jet head and the substrate for ink jet head according to the present invention.
Figure 6B:
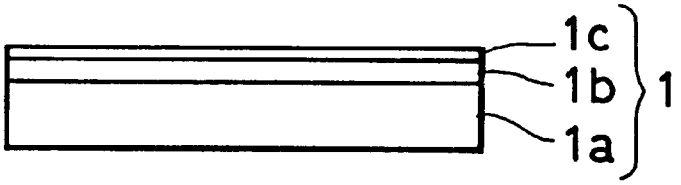

FIG. 6A and FIG. 6B are respectively sectional views of the member for formation of substrate and the substrate which can be used for formation of the heat generating substrate of the present invention.

The member for formation of the substrate shown in FIG. 6A has the constitution having a silicon layer 1*b* which becomes the intermediate layer provided on the ceramics base 1*a* as the support. Further, as shown in FIG. 6B, by forming an $SiO_2$ layer 1*c* which becomes the lower layer on the surface of the silicon layer 16 by thermal oxidation treatment, the substrate 1 of the present invention is formed. By providing at least heat-generating resistors and pairs of electrodes electrically connected to the heat-generating resistors at predetermined intervals in a predetermined number on said substrate 1, the heat-generating substrate of the present invention can be obtained.

The silicon layer 1*b* is formed as the layer of amorphous silicon or polycrystalline silicon, etc., and its layer thickness should be desirably made, for example, 20 $\mu$m or more.

Formation of the silicon layer 1*b* on the ceramics base 1*a* can be performed as described below.

a) On a predetermined surface of the ceramics member such as ceramics plate optionally subjected to rough polishing treatment, a layer of amorphous silicon or polycrystalline silicon is formed according to the film forming method such as the CVD method, the microwave plasma CVD method, electron beam vapor deposition, sputtering, etc.

b) On a predetermined surface of the ceramics member such as ceramics plate optionally subjected to rough polishing treatment, molten silicon is coated and cooled to form a layer of polycrystalline silicon.

As the ceramics member for constituting the ceramics base which can be used in the present invention, a member comprising alumina, aluminum nitride, silicon carbide, silicon nitride, sapphire, etc. can be employed.

By provision of the silicon layer 1*b*, surface defects such as pinholes or projections formed on the surface of the ceramics base 1*a* can be repaired. Also, the surface smoothness can be made further better by polishing the surface of the silicon layer 1*b*. If the surface smoothness of the silicon layer 1*b* is enough, it is necessarily required to effect the polishing treatment as mentioned above.

The thickness of the $SiO_2$ layer should be desirably about 0.5 to 5 $\mu$m. The conditions in the thermal oxidation treatment when forming the $SiO_2$ layer 1*c* may be conveniently chosen corresponding to the layer thickness and the quality of the $SiO_2$ layer to be obtained.

Figure 3A:
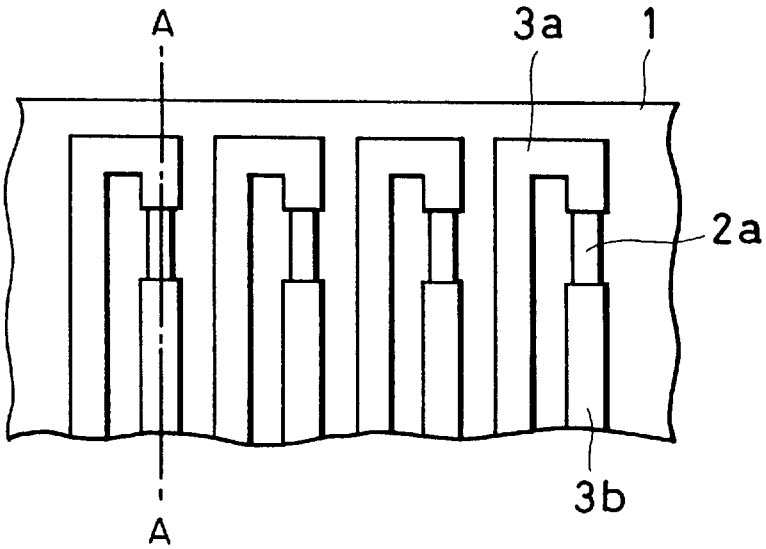
FIG.3A PRIOR ART
FIG. 3A is a schematic top view showing an example of the substrate for ink jet head according to the background art, and FIG. 3B a schematic sectional view taken along A—A in FIG. 3A.
Figure 3B:
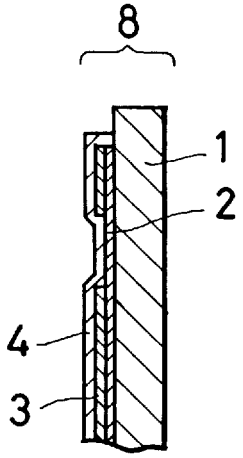
FIG.3B PRIOR ART

For providing at least electrodes 3*a*, 3*b* and the heat-generating resistor 2*a* on the substrate 1 as shown in FIG. 3A and FIG. 3B, techniques, etc. conventionally used in formation of the heat-generating substrate for liquid jet recording head may be utilized.

The arrangements and shapes of the electrodes and the heat-generating resistors are not limited to the embodiments as describe above, but they can be conveniently chosen corresponding to the constitution of the liquid jet recording head formed by use of said heat-generating substrate. Also, the heat-generating substrate of the present invention can further have various upper layers such as protective layer 4, etc. comprising an inorganic material or an organic material on the electrodes, the heat-generating resistor, etc., if necessary.

The liquid jet recording head of the present invention can be obtained from the heat-generating substrate formed by use of the substrate having the constitution as described above. For the points other than the heat-generating substrate of the liquid jet recording head of the present invention, for example, formation of the liquid jet recording head, material and methods conventionally used may be utilized.

To summarize the above description, it may be approximately as follows. That is, the substrate for ink jet head of the present invention has a structure comprising at least three layers of support, intermediate layer and lower layer, and good characteristics can be obtained by the thermal balance of these three layers.

The intermediate layer is formed by choosing the material as described above so that its thermal conductivity may be higher than that of the support and the lower layer. Its thickness may be made preferably 1 μm to 100 μm, more preferably 2 μm to 70 μm, optimally 20 μm to 50 μm. The intermediate layer should be preferably formed thicker than the lower layer.

The material for forming the lower layer is as described above, and its thickness should be made preferably 0.3 μm to 100 μm, more preferably 0.4 μm to 20 μm, optimally 0.5 μm to 5 μm.

Meanwhile, the shape of the intermediate layer may be preferably of one surface solid shape, but it is not necessarily limited thereto. However, for effecting effectively diffusion of heat, the intermediate layer should be extremely preferably extended to below the common liquid chamber 404. Thus, the intermediate layer 115 extends from a position corresponding to a heat generating member, for example heat-acting surface 108 to the common liquid chamber 404. Thus, the intermediate layer 115 extends from a position corresponding to a heat generating member, for example heat-acting surface 108 to the common liquid chamber 404. For, the heat conveyed by the intermediate layer is cooled with the liquid in the common liquid chamber, which is preferable in heat balance (principle of water cooling). In this sense, although not so effective as the water cooling as described above, it is one of the important ways of thinking in the present invention to perform the so called air cooling from the end of the substrate by extending the intermediate layer to the end of the substrate. In specific Examples as described below, without particularly noted, description is made about the case wherein the intermediate layer is extended to at least below the common liquid chamber.

The embodiment particularly suitable for the present invention has an intermediate layer comprising Si formed on a support comprising ceramics, and further a lower layer comprising $SiO_2$ formed thereon. This is because this case is excellent from the point of heat balance, from the point of easiness in preparation as well as from the point in cost.

Also, the present invention should most preferably applied to an ink jet head of the type having electricity-heat converters for generating heat energy as the energy to be utilized for discharging ink in a plural number (e.g. 1000 or more, further 2000 or more) arranged corresponding to the discharge openings. The reason is that the tendency of generation of the problems related to the background art as described above becomes greater when the discharge openings and electricity-heat converters are thus arranged in large numbers at high density.

EXAMPLE 1

A liquid jet recording head having a constitution shown in FIG. 5A to FIG. 5C was prepared as described below.

After an Ag film (thermal conductivity 0.93 cal/cm·sec·° C.) was formed with a film thickness of 2 μm as the intermediate layer 115 on a Si wafer (thermal conductivity 0.2 cal/cm·sec·° C.) by sputtering, an $SiO_2$ film (thermal conductivity 0.003 cal/cm·sec·° C.) was deposited to a film thickness of 3 μm as the lower layer 109 by sputtering, followed by formation of $HfB_2$ as the heat-generating resistance layer 110 to a thickness of 1500 Å, and subsequently a Ti layer 50 Å, an Al layer 6000 Å were continuously deposited.

Next, the electrode portion was subjected to patterning according to the photolithographic steps to form electrodes 113, 114. The dimensions of the heat-acting surface are 35 μm of width and 160 μm of length. Next, an $SiO_2$ layer as the first protective layer 111 was deposited to 1 μm by bias sputtering. Next, a Ta film as the second protective layer 116 was formed to 0.5 μm by magnetron sputtering, and the surrounding Ta film was removed by dry etching so that it remained in the region near the heat-generating portion 107. Next, Phtoneath (a polyimide resin, Toray K.K.) was coated by spinner coating, followed by patterning development so as to expose the Ta surface, thereby forming the third protective layer 112. Then, baking was effected to prepare a heat-generating substrate for liquid jet recording head, and liquid channels, etc. were formed thereon to provide a recording head.

When a recording liquid was supplied to the recording head thus prepared and a pulse-shaped voltage of 23 V with a pulse width of 7 μsec was applied at a frequency of 2 kHz on the heat-generating portion of the electricity-heat converter, the liquid was discharged as droplets corresponding to the recording signals to form flying droplets stably. Here, since the temperature immediately above the heater can be measured with difficulty, the results of the change with time of the temperature of the recording head immediately above the heater during prolonged continuous recording actuation estimated by computer simulation are shown in FIG. 7.

Figure 7:
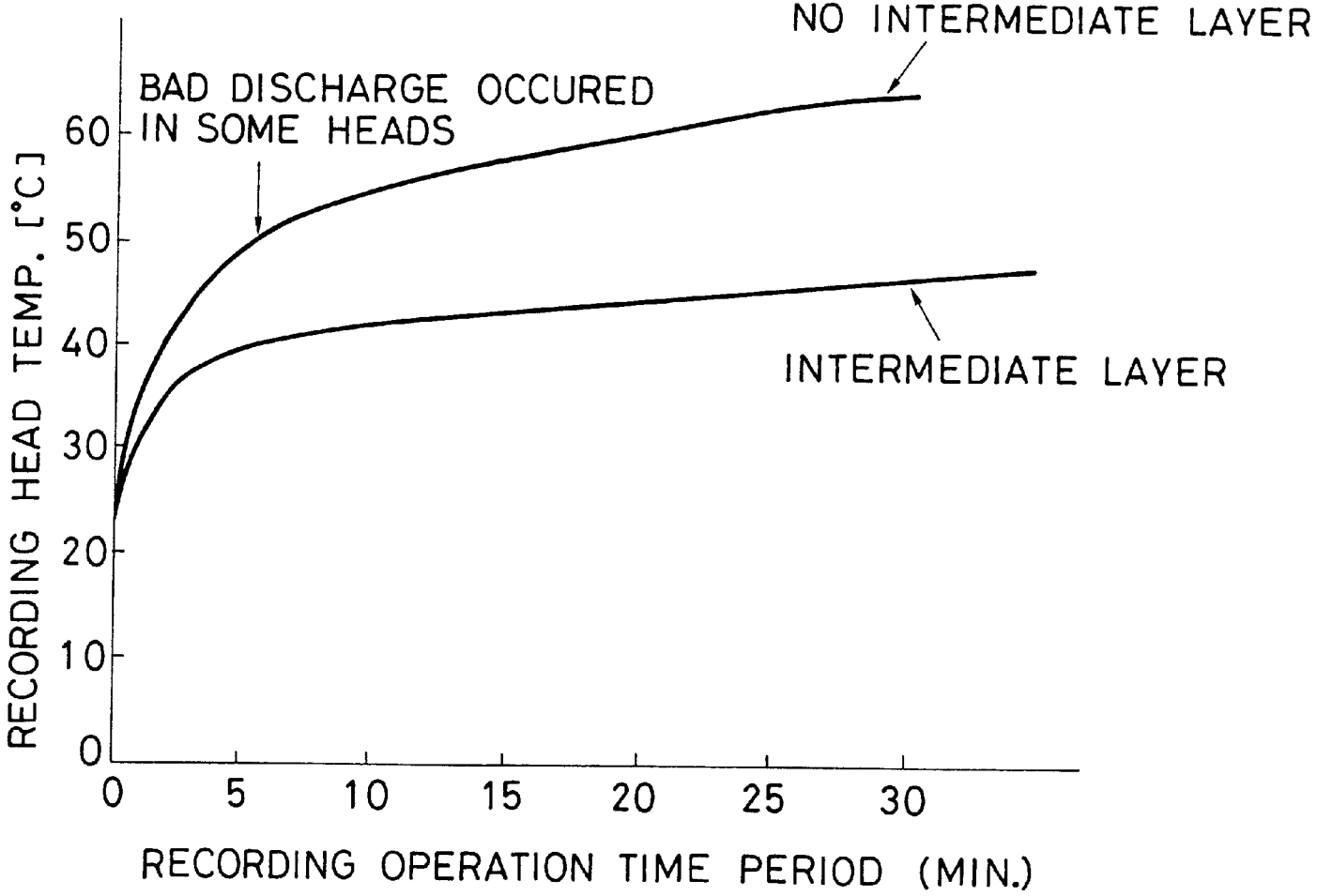
FIG. 7 is a graph showing the change with time of the temperature of an example of the ink jet head according to the present invention.

FIG. 7 shows also the change with time of the recording head having the same constitution as described above except for no formation of intermediate layer. As the result, while among many recording heads having no intermediate layer, intermittent non-discharging was generated within about 5 minutes, whereby heads appeared capable of performing no stable printing appeared, in all of the many recording heads of the present invention, temperature elevation was suppressed, whereby good recording was possible over 30 minutes or longer.

EXAMPLE 2

As another example of the present invention, a liquid jet recording head as described below was prepared.

After an SiC film (thermal conductivity 0.16 cal/cm·sec·° C.) was formed with a film thickness of 5 μm as the intermediate layer 115 by sputtering on a glass substrate (#7059, Corning, thermal conductivity 0.003 cal/cm·sec·° C.), an $SiO_2$ film was deposited to a film thickness of 3 μm as the lower layer 109 by sputtering, followed by formation of $HfB_2$ to a thickness of 1500 Å as the heat-generating resistance layer 110, and subsequently a Ti layer 50 Å, an Al layer 6000 Å were continuously deposited by electron beam vapor deposition. Next, the electrode portion was subjected to patterning according to the photolithographic steps to form the electrodes 113, 114. The dimensions of the heat-acting surface are 30 μm of width and 150 μm of length. Next, the first to the third protective layers were formed and subjected to patterning as described in the foregoing Example to prepare a heat-generating substrate for liquid jet recording head, and liquid channels, etc. were formed thereon to provide a recording head.

When a pulse-shaped voltage of 23.5 V with a pulse width of 8 μsec was applied at a frequency of 2 kHz on the heat-generating portion of the electricity-heat converter, the liquid was discharged as droplets corresponding to the recording signals to form flying droplets stably.

Figure 8:
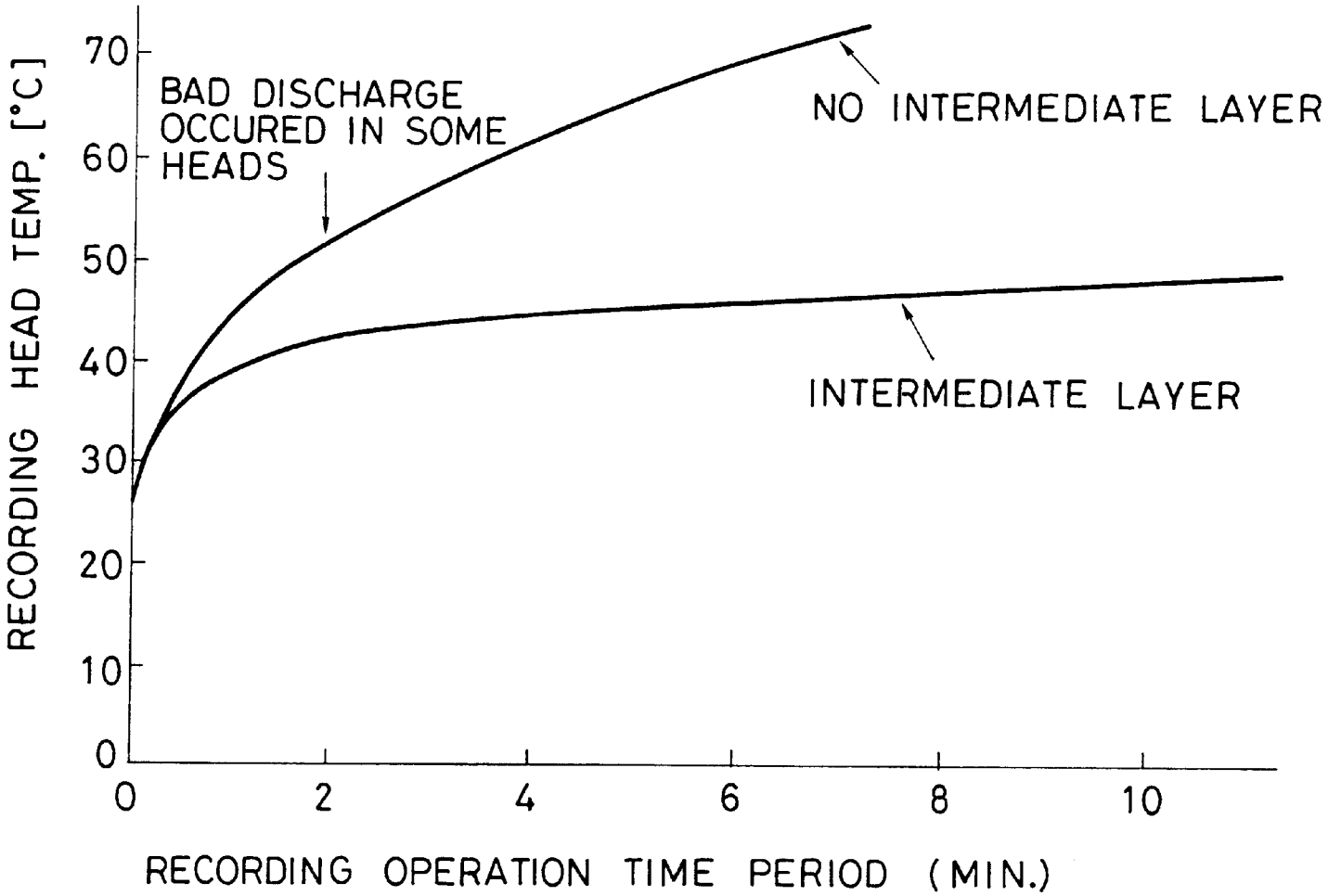
FIG. 8 is a graph showing the change with time of the temperature of another example of the ink jet head according to the present invention.

The change with time of the temperature of the recording head during prolonged continuous actuation in this Example was estimated similarly as in Example 1, and the results are shown in FIG. 8 similarly as in the foregoing Example. FIG. 8 also shows the change with time of the temperature recording head having the same constitution as described above except for no formation of intermediate layer.

As the result, while among many recording heads having no intermediate layer, intermittent non-discharging was generated within about 2 minutes, whereby heads capable of performing no stable printing appeared, in all of the many recording heads of the present invention, temperature elevation was suppressed, whereby good recording was possible over 10 minutes or longer.

As the material for forming intermediate layer, other than SiC, a layer comprising a single element constitution of C, Mg, Al, Cu, Ag, Au or W, a glass layer, a layer comprising a material with higher thermal conductivity than $SiO_2$, such as $Si_3N_4$, $HfB_2$, $TiB_2$, etc. may be also effectively used.

As described above, according to the present invention, by forming an intermediate layer between the lower layer beneath the heat-generating member and the support with a material having higher thermal conductivity than the both, stable recorded images can be obtained even when the recording head may be driven continuously for a long time.

EXAMPLE 3

On one surface of an alumina plate material not subjected to surface polishing ($Al_2O_3$, 97%, size 50 mm×50 mm×0.68 mm), a polysilicon film (about 50 μm) was formed by the CVD method as described below.

First, the alumina plate material arranged at a predetermined position in the chamber of a CVD device was heated to 1100° C., the pressure within the chamber was made about 150 Torr, HCl gas was introduced into the vacuum chamber at a flow rate of 1 liter/min. from a gas introducing system, and also the pressure within the vacuum chamber was controlled to about 150 Torr by an evacuation system, thereby cleaning the alumina plate material surface.

Figures 9A, 9B, 9C, 9D:
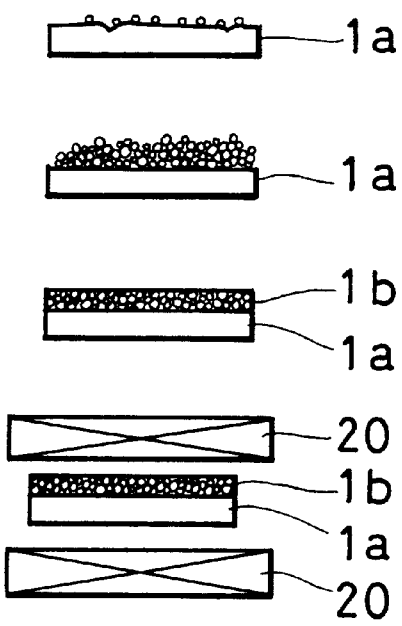
FIGS. 9A–9D are schematic views showing the steps for preparing an example of the substrate for ink jet head according to the present invention

Next, the residual gas within the vacuum chamber was evacuated to a pressure of about 100 Torr, whereupon $SiH_2Cl$ (diluted to 800-fold with hydrogen gas) and HCl as the starting gases were introduced at the respective flow rates of 100 liters/min. and one liter/min. from the gas introducing system, and the temperature of the alumina plate material 1*a* was controlled to 900 to 1100° C. and the pressure within the vacuum chamber to about 150 Torr to effect film formation (FIG. 9A).

The film formation speed onto the cleaned surface of the alumina plate material was about 40 to 60 μm, and film formation was completed when the film thickness became about 50 μm (FIG. 9B). When the film obtained was examined by the electron diffraction method, it was found to be a polycrystalline silicon film.

Next, the polycrystalline silicon film on the alumina plate material was polished with a lap material #1200 of lapping machine and alumina powder (0.2 μm) of buff polishing to its film thickness of about 30 μm (FIG. 9C).

Further, the alumina plate material having the polycrystalline silicon film 1*b* subjected to polishing treatment was placed in a thermal oxidizing furnace 20 and heated to about 1100° C. in an $H_2O$ wet atmosphere (FIG. 9D).

When an alumina/Si/$SiO_2$ substrate thus obtained was examined by an ellipsometer, it was confirmed to have a structure having a $Sio_2$ layer of about 3 μm formed on the polycrystalline silicon layer on the alumina substrate.

The outline of the film formation process according to the CVD method as described above is shown in FIG. 9A to FIG. 9C, and the outline of the process of thermal oxidation in FIG. 9D.

On the $SiO_2$ layer of the substrate obtained as described above, by utilizing the patterning technique by photolithography, heat-generating resistors comprising $HfB_2$ (20 μm×100 μm, thickness 0.16 μm, arrangement density 16 pel) and electrodes comprising Al connected to the respective heat-generating resistors (layer thickness 0.6 μm, width 20 μm) were formed. Under this state, the surface defect of the alumina/Si/$SiO_2$ substrate was evaluated by measuring the generation ratio of defective opening (defect where current passage is impossible due to breaking of wiring). The results obtained are shown below in Table 1.

Finally, by laminating a protective layer comprising $SiO_2$/Ta (layer thickness 2 μm/0.5 μm) on the upper part of the portion where the electrodes and the heat-generating resistors were formed by sputtering, a heat-generating substrate of the present invention was obtained.

Figure 11:
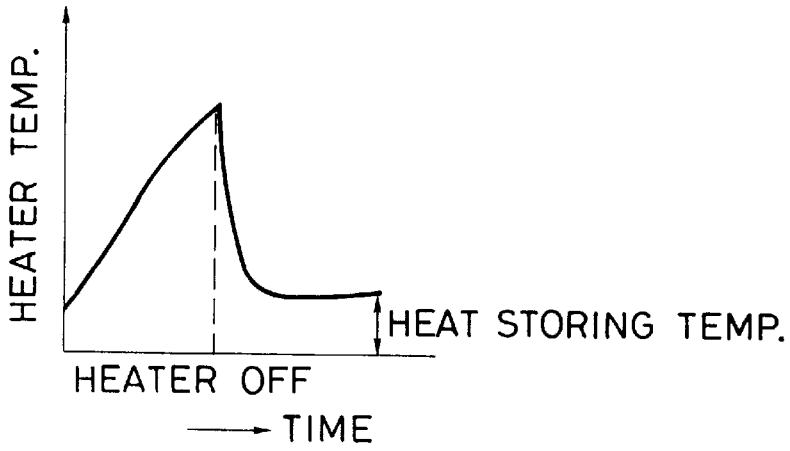
FIG. 11 is a graph for illustration of heat accumulation temperature.
Figure 12:
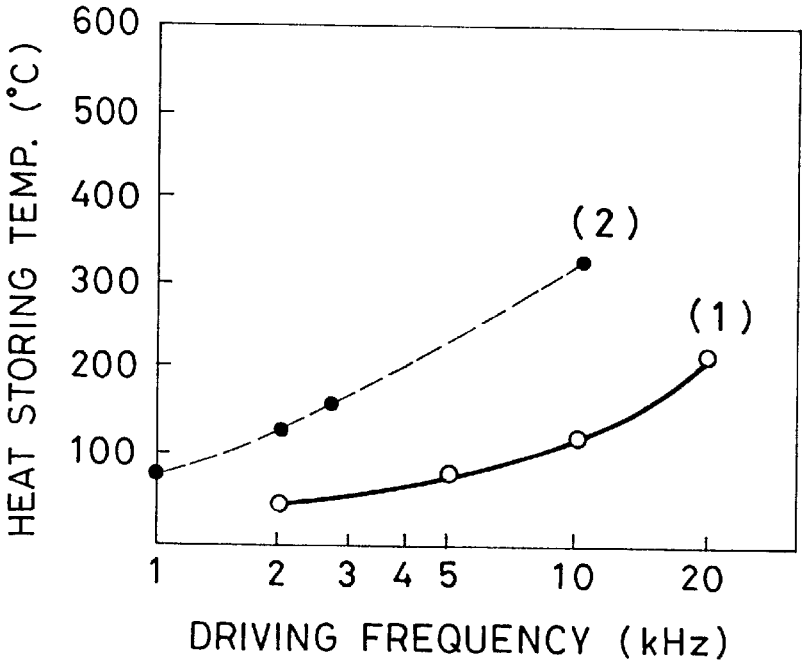
FIG. 12 is a graph for illustration of the relationship between heat accumulation temperature and driving frequency.

By making the temperatures of the respective heat-generating resistors of the heat-generating substrate measurable, electrical signals of 1.2 Vth, pulse width 10 μs were applied on the respective heat-generating resistors from the respective electrodes with various frequencies, and the heat accumulation temperatures were measured under the condition of 25° C. for evaluation of its heat accumulation characteristics. As shown in FIG. 11, the heat accumulation tempreature is defined as the temperature when the temperature became substantially constant after the voltage applied on the heat-generating resistors was made OFF. The results thus obtained are shown in FIG. 12.

Further, under the state where the heat-generating substrate was dipped in a recording liquid having the following composition, the respective heat-generating resistors were driven by application of electrical signals, and the cycle number (all the pulse numbers applied) of the electrical signals (1.1 Vth, pulse width 9 Vs) before occurrence of wire breaking of the heat-generating resistors was measured for evaluation of its durability.

Recording liquid composition:

| | |
|---|---|
| Water | 50% |
| MNP (N-methyl-2-pyrrolidone) | 15% |
| PEG (diethylene glycol) | 30% |
| Dye | 5% |

The results obtained are shown below in Table 2.

COMPARATIVE EXAMPLE 1

Heat-generating substrates were prepared in the same manner as in Example 3 except for using individually an alumina glaze substrate (50 mm×50 mm×0.68 mm) consisting of:

| | |
|---|---|
| $Al_2O_3$ | 97% |
| glaze layer | 40 μm |
| $SiO_2$ | 50–68 wt. % |
| BaO | 5–18 wt. % |
| $Al_2O_3$ | 5–13 wt. % |
| Others | balance % |

and, or a glass substrate (50 mm×50 mm×0.7 mm), and their heat accumulation temperatures were measured.

The results obtained are shown in FIG. 12.

COMPARATIVE EXAMPLE 2

A substrate was obtained in the same manner as in Example 1 except for forming no polycrystalline silicon layer and $SiO_2$ layer on the alumina plate material. The generation ratio of defective opening and durability were evaluated similarly as in Example 3. The results obtained are shown in Tables 1 and 2.

TABLE 1

| | Defective opening generation ratio |
|---|---|
| Example 1 | 0.4% |
| Comparative example 2 | 80% |

TABLE 2

| | Heater residual ratio to each driving cycle | | |
|---|---|---|---|
| Driving cycle | $1 \times 10^8$ | $2 \times 10^8$ | $3 \times 10^8$ |
| Example 1 | 100% | 100% | 100% |
| Comparative example 2 | 20% | 0% | 0% |

As is apparent from the results of Example 3 and Comparative examples 1–2, the substrate by use of the alumina/$Si/SiO_2$ substrate of the present invention has excellent heat dissipatability and adequate heat accumulatability as compared: with the substrate by use of a glass substrate or an alumina glaze substrate. Particularly, it is excellent in balance between heat dissipatability and heat accumulatability at the frequency band of 7.8 kHz or less which has been widely employed in driving of liquid jet recording head. Also, the heat-generating substrate by use of the alumina/$Si/SiO_2$ substrate of the present invention became markedly improved in durability as compared with the heat-generating substrate by use of an alumina substrate.

EXAMPLE 4

Figures 10A, 10B, 10C, 10D:
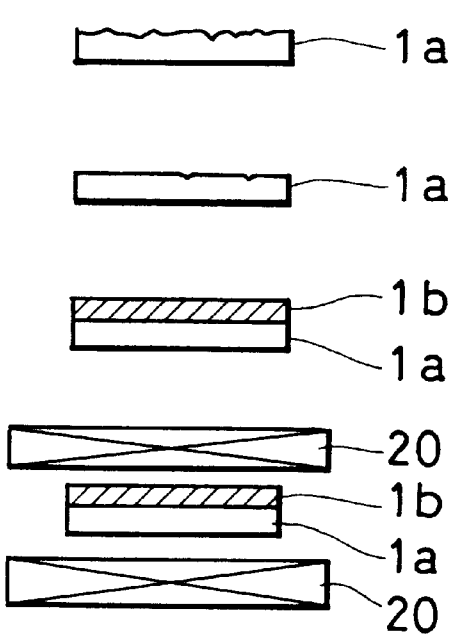
FIGS. 10A–10D are schematic views showing the steps for preparing another example of the substrate for ink jet head according to the present invention.

First, the surface of the same alumina plate material as used in Example 3 (FIG. 10A) was subjected to rough lapping by use of lap abrasives (SiC) to remove extreme unevenness (FIG. 10B).

Next, according to the microwave plasma CVD method, an amorphous silicon layer with a thickness of about 30 μm was formed on the surface of the roughly lapped alumina plate material 1*a* as described below.

The roughly lapped alumina plate material was arranged at a predetermined position within the chamber of a microwave plasma CVD device, the chamber was internally evacuated to about $10^{-6}$ Torr, the temperature of the alumina plate material was maintained at 200 to 300° C., $SiH_4$ gas was introduced from a starting material introducing system at a flow rate of 10 to 100 sccm, and the microwave of a frequency of 2.45 MHz and an output of 10 to 100 W was introduced from a microwave introducing pipe into the chamber, whereby film formation was effected on the roughly lapped surface of the alumina plate material. The pressure in the chamber during film formation was controlled to $0.5\times10^{-3}$~$1\times10^{-3}$ Torr. When a film 1*b* with a thickness of about 30 μm was obtained, film formation was completed (FIG. 10C).

When the film obtained was examined by the electron beam diffraction method, it was found to be an amorphous silicon film. The amorphous silicon film on the alumina plate material had good surface characteristic, and therefore it is not required to be subjected to polishing treatment.

Further, the alumina plate material having the amorphous silicon film was placed in a thermal oxidation furnace 20 and heated to about 1100° C. in an $H_2O$ wet atmosphere (FIG. 10D).

FIGS. 10A–10D show the outline of the formation process of the substrate in this Example, in which FIG. 10A, 10B show the rough lapping process, FIG. 10C the film formation process according to the microwave plasma CVD method and FIG. 10D the thermal oxidation process.

When the alumina/$Si/SiO_2$ substrate was examined by an ellipsometer, it was confirmed to have a structure having a $SiO_2$ layer of about 3 μm formed on the surface of the amorphous silicon layer on the alumina base. Further, on the alumina/$Si/SiO_2$ substrate were provided heat-generating resistors, electrodes and protective layer similarly as in Example 3, to give a heat-generating substrate.

When the heat accumulation characteristic, the durability, the defective opening generation ratio in the heat-generating substrate obtained were examined similarly as in Example 3, the same results as in the heat-generating substrate obtained in Example 3 were obtained.

EXAMPLE 5

Figure 13:
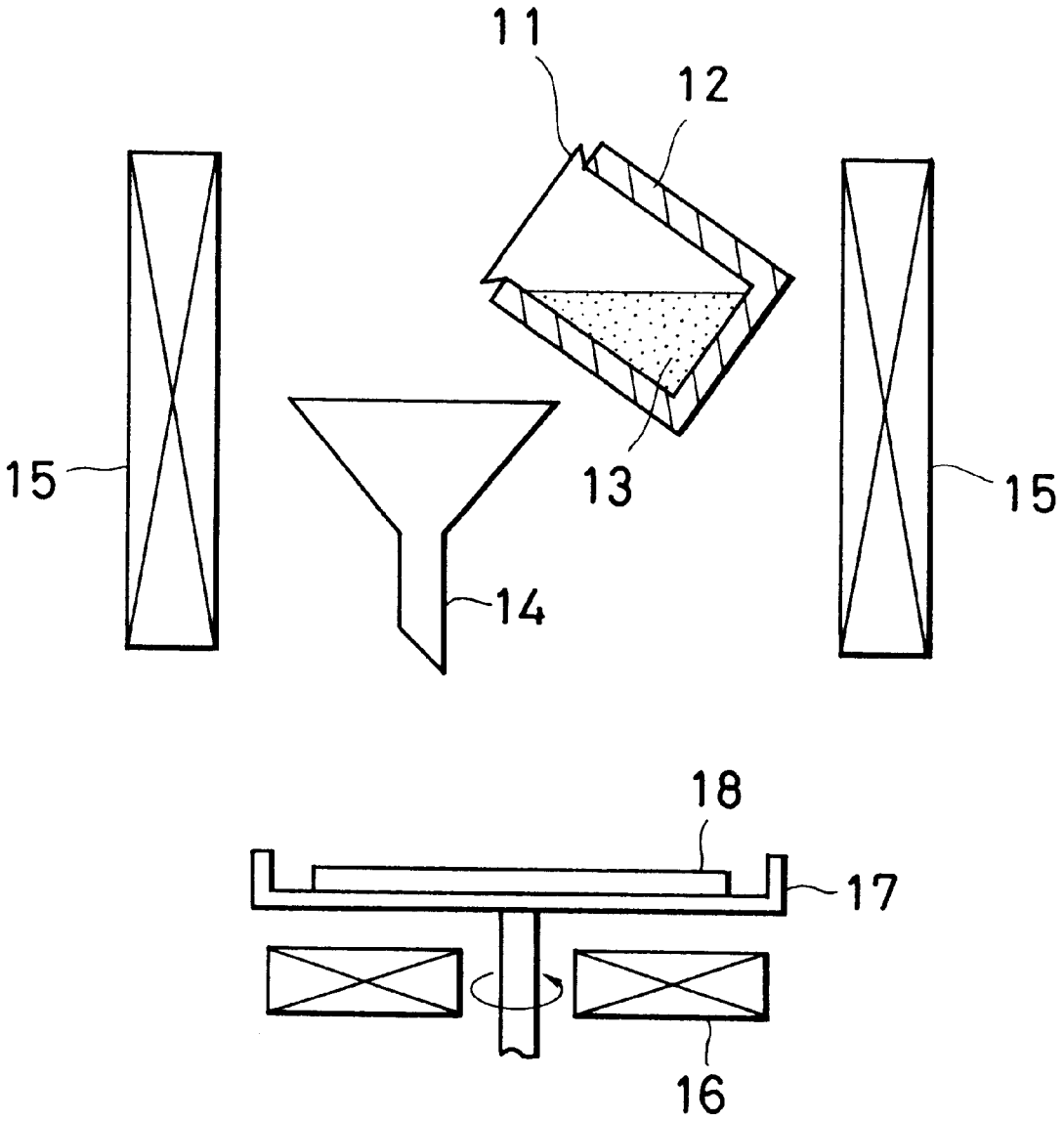
FIG. 13 is a schematic view showing the method for preparing another example of the substrate for ink jet head according to the present invention.

On the surface of the same alumina plate material as used in Example 3, a polycrystalline silicon layer was formed by means of a device having a constitution shown in FIG. 13 as described below.

That is, a quartz crucible 11 (surrounded by covering or a graphite layer 12) was heated by a carbon heater 15 to 1450° C., molten silicon 13 was prepared in the quartz crucible 12 and the molten silicon was added dropwise from a quartz funnel 14 onto the surface of an alumina plate material 18 heated to 1000 to 1400 °C. on a holder 17 rotating at 100 to 400 rpm. The molten silicon droplets added dropwise on the alumina plate surface spreaded by centrifugal force to be solidified with formation of a layer having a thickness of 0.2 to 0.5 mm.

Next, the polycrystalline film on the alumina plate substrate was polished until its film thickness became about 30

μm. Further, the alumina plate material having the polished polycrystalline silicon film was placed in a thermal oxidation furnace and heated to about 1100° C. in an $H_2O$ wet atmosphere.

When the alumina/Si/$SiO_2$ substrate thus obtained was examined by an ellipsometer, it was confirmed to have a structure having a $SiO_2$ layer of about 3 μm formed on the surface of the polycrystalline silicon layer on the alumina base.

Further, on the alumina/Si/$SiO_2$ substrate were provided heat-generating resistors, electrodes and protective layer similarly as in Example 3 to give a heat-generating substrate.

When the heat accumulation characteristic, the durability, the defective opening generation ratio in the heat-generating substrate obtained were examined similarly as in Example 3, the same results as in the heat-generating substrate obtained in Example 3 were obtained.

EXAMPLE 6

Figure 2A:
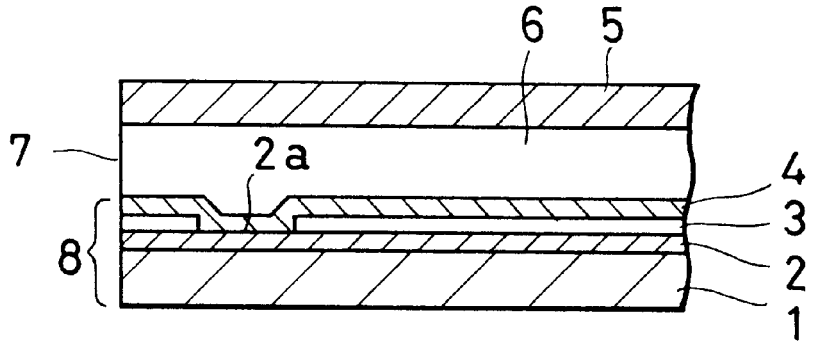
FIG.2A PRIOR ART
FIG. 2A is a schematic sectional view showing another example of the ink jet head according to the background art, and FIG. 2B its exploded perspective view.
Figure 2B:
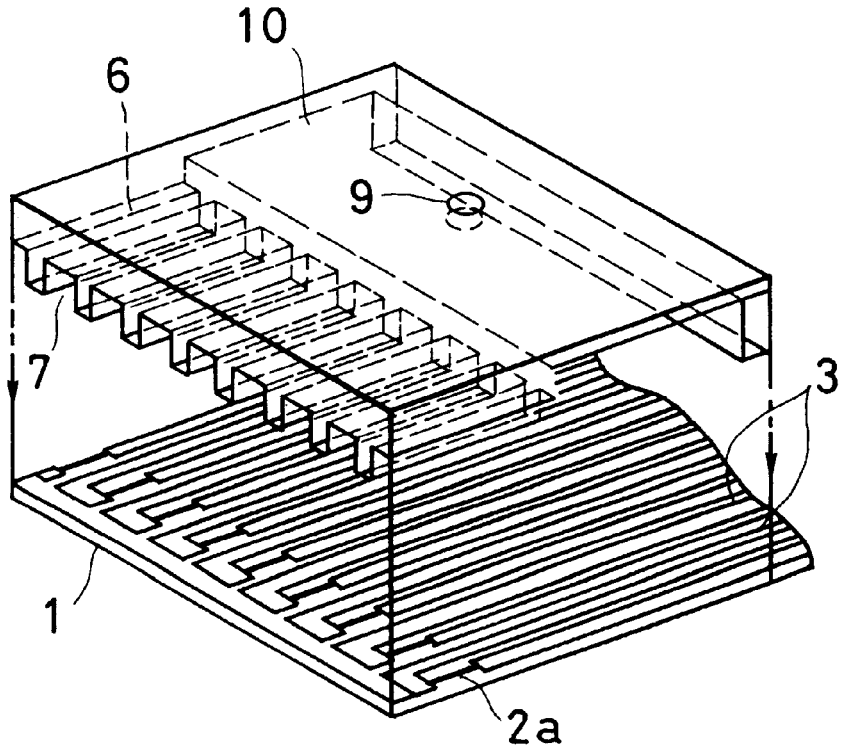
FIG.2B PRIOR ART

On each of the heat-generating substrates obtained in Examples 3 to 5 were formed orifices, liquid channels and liquid chambers as same as shown in FIGS. 2A and 2B, by use of a photo sensitive resin such as the so called dry film, etc. to prepare a liquid jet recording head.

When the characteristics such as discharging stability, durability, etc. were evaluated by driving the recording head obtained, the results obtained in Examples 3 to 5 were reflected.

According to the present invention, there can be provided a substrate for liquid jet recording head having good balance of heat accumulativity and heat dissipatability, and having good characteristics such as excellent durability.

Also, by constituting the liquid jet recording head by use of the substrate for liquid jet recording head of the present invention, there can be provided a liquid jet recording head with excellent discharging stability, durability and also with extremely little defect generation ratio.

Figure 14:
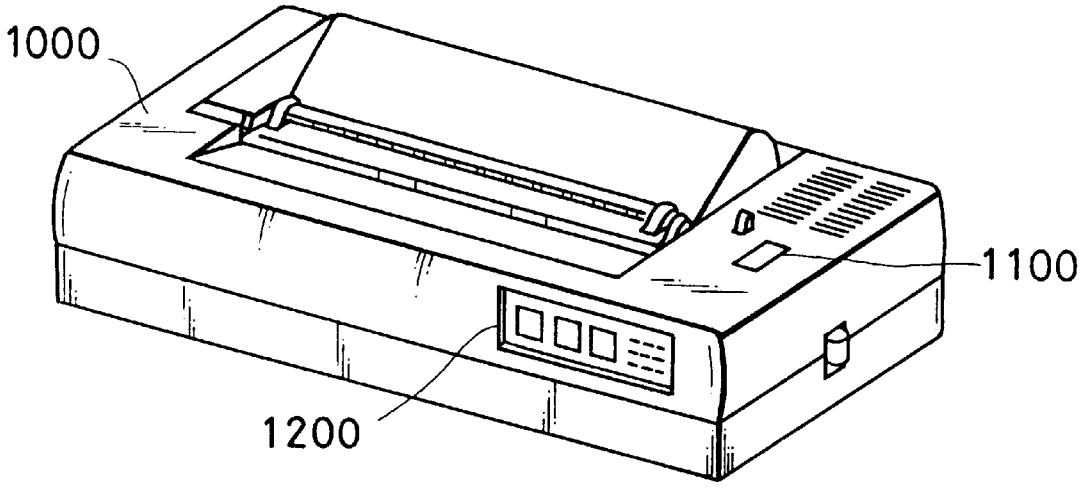
FIG. 14 is a schematice perspective view showing the appearance of the ink jet device having the ink jet head according to the present invention mounted thereon.

FIG. 14 is a schematic perspective view showing the appearance of the ink jet device having the ink jet according to the present invention mounted thereon. In FIG. 14, the symbol 1000 is a main device, the symbol 1100 a power source switch and the symbol 1200 an operation panel.

The present invention brings about excellent effects particularly in a recording head, recording device of the bubble jet system among the ink jet recording systems.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleus boiling corresponding to the recording information on an electricity-heat converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid through an opening for discharging by growth and shrinkage of the bubble, at least one droplet is formed. By making the driving signals into pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat converters as the discharging portion of the electricity-heat converter or Japanese Patent Application Laid-Open No. 59-138461 which discloses the constitution having the opening for absorbing pressure of heat energy corresponding to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above, further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black etc., but also a device equipped with at least one or plural different colors or full color by color mixing, whether the recording head may be either integrally constituted or combined in plural number.

In the Examples of the present invention as described above, description has been made by use of a liquid ink, but in the present invention, either an ink which is solid at room temperature or an ink which becomes softened at room temperature can be also used.

In the ink jet device as described above, the temperature is generally controlled to make the viscosity of the ink within a stable discharging range by controlling the temperature of the ink itself within the range from 30 to 70 ° C., and therefore the ink may be liquid when imparting the recording signals to be used. In addition, by preventing the temperature elevation by the heat energy by utilizing it positively as the energy for the state change from the solid state to the liquid state of the ink, or by using an ink which is solidified when left to stand for the purpose of preventing vaporization of the ink, anyway by imparting heat energy corresponding to the recording signals, the ink may be liquefied to be discharged as liquid or it may begin to be already solidified on reaching the recording medium. Use of an ink having such properties is also applicable to the present invention.

In such case, the ink may be also made to have a form opposed to an electricity-heat converter under the state held as liquid or solid material in the porous sheet concavity or thru-hold as described in Japanese Patent Application Laid-Open No. 54-56847 or No. 60-71260. In the present invention, the most effective one for the respective inks as described above is one which practices the film boiling system as described above.

What is claimed is:

1. An ink jet head, comprising:

a support having a surface characteristic;

an intermediate layer provided on said support and which said intermediate layer improves the surface characteristic of the support;

a lower layer provided on said intermediate layer; and a plurality of heaters provided on said lower layer for generating heat energy to discharge an ink, wherein said support comprises at least one of a ceramic material and a glass material, said intermediate layer comprises silicon and has a thermal conductivity higher than said lower layer and said support, and said lower layer comprises a layer of silicon dioxide having a thickness of between about 0.5 $\mu$m and 5 $\mu$m, inclusive, and further comprising;

a plurality of ink channels each having a discharge opening and which are provided in correspondence with said heaters; and a common chamber for supplying the ink to said plurality of ink channels, said intermediate layer extending from a position beneath said heaters to a position beneath said common chambers, wherein said intermediate layer conducts heat from beneath said heaters toward said common chamber.

2. An ink jet head as in claim 1, wherein saidheater is an electro-thermal converter comprise:

a heat-generating resistance layer; and a plurality of electrodes electrically connected to said heat-generating resistance layer.

3. An ink jet head as in claim 2, wherein said electric-heat converter further comprises at least one protective layer disposed on said heat-generating resistance layer and said electrodes.

4. An ink jet head as in any one of claims 2, 3 or 1, wherein a thermal conductivity of said intermediate layer is at least twice a thermal conductivity of said support.

5. An ink jet head as in any one of claims 2, 3 or 1, wherein a thermal conductivity of said intermediate layer is at least twice a thermal conductivity of said lower layer.

6. An ink jet head as in any one of claims 2, 3 or 1, wherein said intermediate layer has a thickness which is between approximately 1 $\mu$m and approximately 100 $\mu$m, inclusive.

7. An ink jet head as in claim 6, wherein said intermediate layer has a thickness which is between approximately 2$\mu$ and approximately 70 $\mu$m, inclusive.

8. An ink jet head as in claim 7 wherein said intermediate layer has a thickness which is between approximately 20 $\mu$m and approximately 50 $\mu$m, inclusive.

9. An ink jet head as in any one of claims 2, 3 or 1, wherein said intermediate layer is thicker than said lower layer.

10. An ink jet head as claimed in claim 1, wherein said intermediate layer further comprises one of amorphous silicon and polycrystalline silicon.

11. An ink jet head as claimed in any one of claims 10 or 1, wherein said intermediate layer further comprises a polished surface.

12. An ink jet head as in any one of claims 10 or 1, wherein the ceramics material of said support is selected from the group consisting of: alumina, aluminum nitride, silicon carbide, silicon nitride and sapphire.

13. An ink jet head as in claim 1, wherein said ink is discharged from said discharge opening in a discharge direction, and said ink is fed through said ink channel to a heat-generating portion of said heaters in a feed direction, which feed direction is substantially the same as said discharge direction.

14. An ink jet head as claim 1, wherein said ink is discharged from said discharge opening in a discharge direction, and said ink is fed through said ink channel to a heat-generating portion of said heaters in a feed direction, which feed direction is different from said discharge direction.

15. An ink jet head as claimed in claim 14, wherein said discharge direction and said feed direction are substantially perpendicular.

16. An ink jet head as claimed in any one of claims 1–15, wherein a plurality of said discharge openings are assembled adjacent to one another so as to have a total width which matches a width of a recording medium used with said ink jet head.

17. An ink jet printer for recording by mounting an ink jet head, said ink jet head comprising a support having a surface characteristic;

an intermediate layer provided on said support and which said intermediate layer improves the surface characteristic of the support;

a lower layer provided on said intermediate layer; and a plurality of heaters provided on said lower layer for generating heat energy to discharge an ink, wherein said support comprises at least one of a ceramic material and a glass material, said intermediate layer comprises silicon and has a thermal conductivity higher than said lower layer and said support, and said lower layer comprises a layer of silicon dioxide having a thickness of between about 0.5 $\mu$m and 5 $\mu$m, inclusive, and further comprising;

a plurality of ink channels each having a discharge opening and which are provided in correspondence with said heater; and a common chamber for supplying the ink to said plurality of ink channels, said intermediate layer extending from a position beneath said heaters to a position beneath said common chamber, wherein said intermediate layer conducts heat from beneath said heaters toward said common chamber.

* * * * *

UNITED STATES PATENT AND TRADEMARK OFFICE

CERTIFICATE OF CORRECTION

PATENT NO. : 6,086,187
DATED : July 11, 2000
INVENTOR(S) : Yoshifumi Hattori, et al.

It is certified that error appears in the above-identified patent and that said Letters Patent is hereby corrected as shown below:

Title page,
Item [56], References Cited, under U.S. PATENT DOCUMENTS
"4,612,533" should read -- 4,612,433 --; and Under FOREIGN PATENT DOCUMETS
"0289130" should read -- 0289139 --; and
"60-71260 4/1958 Japan" should read
-- 60-71260 4/1985 Japan --.

Drawings,
Sheet 6 of 11, FIG. 7, "OCCURED" should read -- OCCURRED --; and
Sheet 7 of 11, FIG. 8, "OCCURED" should read -- OCCURRED --.

Column 2,
Line 17, "phenomenon" should read -- phenomena --.

Column 3,
Line 32, "so called" should read -- so-called --.

Column 6,
Line 20, "lower" should read -- lower layer -----; and
Line 51, "suppresses" should read -- suppress --.

Column 8,
Line 39, "great" should read -- a great --.

Column 9,
Line 20, "heat-generating portion 106" should read -- heat-acting portion 106 --;
Line 24, "surface." should read -- as its bottom surface. --; and
Line 58, "When," should read -- When --.

Column 10,
Line 27, "layer 16" should read -- layer 1*b* --.

UNITED STATES PATENT AND TRADEMARK OFFICE

CERTIFICATE OF CORRECTION

PATENT NO. : 6,086,187
DATED : July 11, 2000
INVENTOR(S) : Yoshifumi Hattori, et al.

It is certified that error appears in the above-identified patent and that said Letters Patent is hereby corrected as shown below:

Column 11 ,
Line 6, "describe" should read -- described --;
Lines 46-48 should be deleted;
Line 49, "For," should read -- For --; and
Line 67, " applied" should read -- be applied --.

Column 12,
Line 31, "portion 107." should read -- portion 101. --.

Column 14,
Line 5, "60 $\mu$m, " should read -- 60 $\mu$sec, --;
Line 22, "$Sio_2$" should read -- $SiO_2$ --; and
Line 55, "tempreature" should read -- temperature --.

Column 15,
Line 54, "accumulatability" should read -- accumulability --;
Line 55, "pared:" should read -- pared --; and
Line 57, "accumulatability" should read -- accumulability --.

Column 16,
Line 63, "spreaded" should read -- spread --.

Column 17,
Line 23, "as same as" should read -- the same as --;
Line 24, "photo sensitive" should read -- photosensitive --;
Line 45, "head," should read -- head, a --; and
Line 56, "an" should be deleted.

UNITED STATES PATENT AND TRADEMARK OFFICE

CERTIFICATE OF CORRECTION

PATENT NO. : 6,086,187
DATED : July 11, 2000
INVENTOR(S) : Yoshifumi Hattori, et al.

It is certified that error appears in the above-identified patent and that said Letters Patent is hereby corrected as shown below:

Column 18,
Line 38, "for the case" should be deleted;
Line 54, "only" should be deleted --; and
Line 61, "by" should read -- of --.

Column 19,
Line 8, "anyway" should be deleted;
Line 38, "comprising;" should read -- comprising: --;
Line 48, "saidheater" should read -- said heater --; and
Line 49, "comprise:" should read -- comprising: --.

Column 20,
Line 4, "claim 7" should read -- claim 7, --;
Line 26, "as" should read -- as in --;
Line 35, "claims 1-15," should read -- claims 1 or 13 to 15, --;
Line 40, "comprising" should read -- comprising: --; and
Line 55, "comprising;" should read -- comprising: --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*